US006795031B1

(12) United States Patent
Walker et al.

(10) Patent No.: US 6,795,031 B1
(45) Date of Patent: Sep. 21, 2004

(54) MECHANICALLY SCANNED PARABOLIC REFLECTOR ANTENNA

(75) Inventors: Scott Walker, Scottsdale, AZ (US); Terry B. Wilson, Chandler, AZ (US); Gary M. Hamman, Scottsdale, AZ (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 10/194,573

(22) Filed: Jul. 12, 2002

(51) Int. Cl.[7] ..... H01Q 1/32
(52) U.S. Cl. ..... 343/713; 343/761
(58) Field of Search ..... 343/711, 712, 343/713, 755, 840, 761

(56) References Cited

U.S. PATENT DOCUMENTS 1,931,980 A * 10/1933 Clavier ..... 342/417
3,798,655 A * 3/1974 Meek et al. ..... 343/754
4,562,439 A * 12/1985 Peralta et al. ..... 342/81
5,526,008 A * 6/1996 Meserole et al. ..... 343/761
6,034,642 A * 3/2000 Kojima et al. ..... 343/753
6,275,180 B1 * 8/2001 Dean et al. ..... 342/70
6,278,360 B1 * 8/2001 Yanagi ..... 340/436

* cited by examiner

*Primary Examiner*—Shih-Chao Chen
(74) *Attorney, Agent, or Firm*—Rader, Fishman & Grauer PLLC

(57) ABSTRACT

A wave guide scanner assembly has an antenna constructed of a parabolic dish that refelects radar signals from a transceiver and reflective plate to a target. Radar signals reflected from the target are then antenna, sent back to the reflective plate, which sends the radar signal to the transceiver. The transceiver can be positioned at the focal point of the antenna, thereby omitted the reflective plate. The radar signals are then transmitted directed to the antenna from the transceiver, and sent to the target by the antenna. Reflected radar signals are then reflected directly back to the transceiver from the antenna. The antenna oscillates back and forth.

19 Claims, 3 Drawing Sheets

MECHANICALLY SCANNED PARABOLIC REFLECTOR ANTENNA

BACKGROUND OF THE INVENTION

The present invention relates to a mechanically scanned parabolic reflector antenna, and more particularly, the present invention relates to a mechanically scanned parabolic reflector antenna for a vehicular collision warning system.

The present construction is directed towards a motor vehicular collision warning system, which includes a scanned beam sensor, a signal processor, and a vehicle interface system that initiates warnings to the driver or adaptively controls the vehicle. In this forward looking collision warning system, the sensor is designed to project a narrow beam of energy toward objects in the forward field of view. Energy reflected from an object in the vehicle path is received by the vehicular collision warning system and processed to determine whether a collision condition exists. If a collision condition exists, the system initiates a response to the condition.

While this system acts to sense collision conditions and respond thereto, some drawbacks exist. Specifically, targets that create potential obstacles for the vehicle must be identified long before they become close to the vehicle. This is to allow the system or driver proper time to react. Specifically, the target must be sensed and responsive action must be taken far before the target becomes close to the vehicle. To meet this need, the system must be able to efficiently transmit and receive radar signals over large distances. This may require complicated and large components, thereby requiring a large amount of space on the vehicle to mount the sensing system. As conventional vehicles are limited in allowable space for such a system, this presents obvious difficulties when applying the system to a vehicle.

Therefore, it is an object of the present invention to avoid the aforementioned disadvantages and problems associated with existing wave antenna scanners.

SUMMARY OF THE INVENTION

In accordance with this invention, a radar apparatus is provided with a rotatable reflective antenna structure driven to oscillate back and forth. The antenna structure is parabolic and reflective, thereby focusing a beam of radar signals having a narrow azimuth toward a target. The radar signals are provided to the antenna structure from a transceiver coupled to the antenna structure. The antenna structure directs radar signals, reflected by the target, back to the transceiver. The scanned signals are directed to a processor and then to a vehicle interface system for initiating warnings to the driver or adaptively controlling the vehicle. The use of the reflective antenna allows the present invention to focus or direct radar signals provided from the transceiver.

In one aspect of the invention, the transceiver transmits the radar signals against a reflective plate, which in turn, directs the radar signals at the antenna structure. Radar signals reflected from the target are then directed from the antenna to the reflective plate. The reflective plate then directs the radar signals to the transceiver. Accordingly, the limited vehicle space is accommodated by advantageously positioning the system components while the parabolic antenna structure focuses the beam and minimizes energy loss.

In another aspect of the present invention, the transceiver is positioned at the focal point of the parabolic antenna, thereby omitting the reflector dish. The radar signals are transmitted directly to the antenna from the transceiver, and sent to the target by the antenna. Reflected radar signals are then reflected directly back to the transceiver from the antenna.

The foregoing and other advantages and features of the invention will be more apparent from the following description when taken in connection with the accompanying drawings.

DETAILED DESCRIPTION OF A PREFERRED EMBODIMENT

Figure 1:
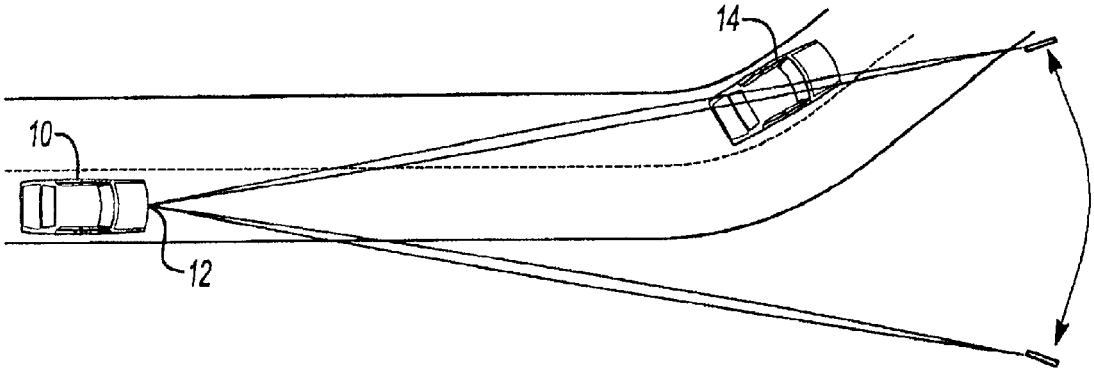
FIG. 1 is an illustration of one embodiment of an environment wherein the present invention may be used.

FIG. 1 illustrates one embodiment of an environment in which the present invention is useful. A traveling vehicle 10 has a vehicular collision warning system 12 mounted at a front portion of the vehicle body. The collision warning system emits a forward signal, such as a radar wave, from the vehicle and also receives a reflected wave from an obstacle, such as another vehicle 14, which is driving towards or away from vehicle 12. The collision warning system measures the distance between the traveling vehicle 10 and the other vehicle 14. If the system detects an object directly in front of the traveling vehicle, it automatically activates an alarm or adaptively controls the vehicle by, for example, activating a brake to supply a braking force to the vehicle's wheels.

Thus, the vehicular collision warning system notifies the driver of an impending collision or initiates evasive action to avoid a collision or actively adjusts the vehicle speed to maintain a time headway to the closest in path object. Warnings may be visual, auditory, or tactile and the vehicle control actions may include braking, throttle control, transmission control and evasive steering.

Figure 2:
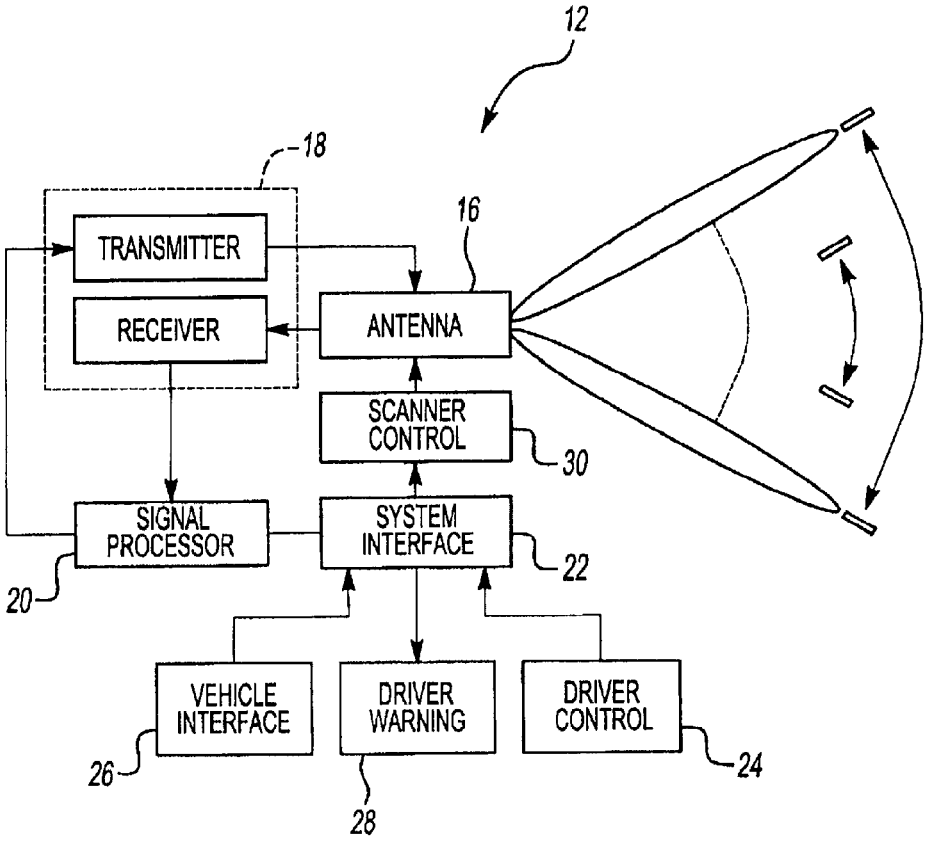
FIG. 2 is a schematic block diagram of a vehicular collision warning system which includes the present invention.

Referring now to FIG. 2, the forward looking collision warning system 12 of the present invention is provided with a rotatable antenna structure 16 which may be in the form of a parabolic dish as will be described in greater detail hereinafter. The antenna 16 is driven to oscillate back and forth at an angle of 12° or less in each direction. A transceiver 18 transmits radar signals to and receives reflected radar signals from the antenna structure 16. The antenna structure 16 directs radar signals from the transceiver 18 to a target and directs reflected radar signals from the target to the transceiver as the antenna structure 16 oscillates back and forth. The scanned signals are directed to a processor 20 and then to a system interface 22 which receives input from a driver control 24 and a vehicle interface 26. The outputs from the system interface 22 are directed to a driver warning or adaptive control 28 as well as to the scanner control 30.

Figure 3:
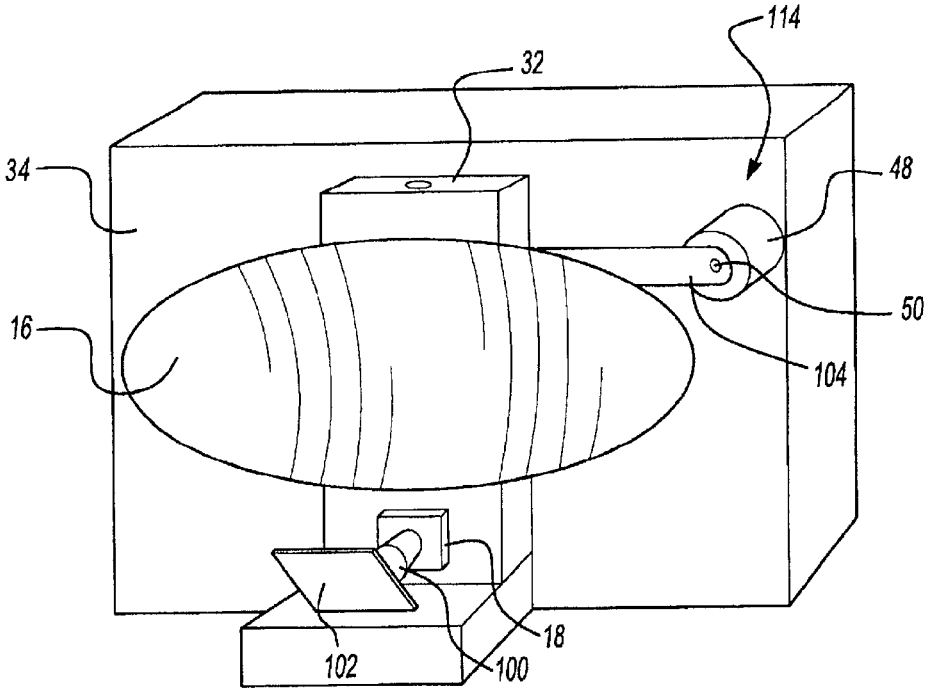
FIG. 3 is a perspective view of one embodiment of a vehicular collision warning system incorporating the teachings of the present invention.

The motor vehicular collision warning system 12 is shown in more detail in FIG. 3. The motor vehicular collision warning system 12 includes the antenna structure 16, transceiver 18, cone 100, scanner assembly 32, and oscillator assembly 114. Antenna structure 16 is shaped as a parabolic dish to direct radar signals in a desired direction at a desired configuration such as a columnar beam. The parabolic shape of antenna structure 16 also allows for directing radar signals reflected from a target toward the transceiver 18 in an efficient manner. Antenna structure 16 is mounted to scanner assembly 32. Scanner assembly 32 is mounted to a chassis 34 of the vehicle and allows the antenna structure 16 to angularly oscillate back and forth at a desired frequency. Preferably, detachable connection 110 (see FIG. 7) effectuates the attachment of antenna structure 16 to scanner assembly 32, which can be by bolts or other known means of detachable fastening. This allows antenna structure 16 to be detached, thereby permitting another antenna structure to be mounted thereto. For example, a slotted wave guide antenna structure may be attached by detachable connection 110 instead of the parabolic antenna structure described in the present invention. The slotted wave guide antenna structure is described in U.S. patent application Ser. No. 09/928,758 filed Aug. 13, 2001, assigned to the assignee of record in the present application, and is hereby incorporated by reference. Additionally, other configurations of antennas may also be attached by the detachable connection 110. Accordingly, the present invention allows a multiple number of antenna configurations to be used, thereby allowing the user to choose a desired antenna for a desired vehicle, road or environment condition.

The transceiver 18 is built into the support structure of the system and transmits and receives radar signals through cone 100. Cone 100 preferably angularly increases in a direction away from transceiver 18 to allow radar signals to expand when traveling away from transceiver 18. This expansion maximizes usage of the surface area of antenna structure 16 while minimizing the size of transceiver 18.

Reflective plate 102 is a substantially rectangular in shape, and is affixed to support structure of the system. Reflective plate 102 is positioned to direct signals between antenna structure 16 and cone 100. Although reflective plate 102 is shown in the current embodiment as being rectangular, one skilled in the art will understand that other shapes and configurations such as a circular, elliptical, rectangular or other type of reflective plate can be used for reflecting radar signals, and the present invention is not limited to the configurations disclosed herein.

The antenna structure 16 oscillates back and forth by the action of scanner assembly 32 and oscillator assembly 114. Oscillator assembly 114 includes coil 48, magnet 50 and arm 104. Arm 104 is attached at one end to magnet 50 and attached to scanner assembly 32 at a second end. The oscillation, operation, and interrelation of scanner assembly 32 including coil 48 and magnet 50 is generally described in U.S. patent application Ser. No. 09/928,758 filed Aug. 13, 2001, assigned to the assignee of record in the present application, and incorporated by reference.

In the present application, coil 48 and magnet 50 are positioned at a distance away from scanner assembly 32. Arm 104 bridges oscillator assembly 114 to scanner assembly 32 for providing rotational movement to antenna structure 16. Current applied to coil 48 causes displacement of magnet 50 and attached arm 104, thereby moving scanner assembly 32 and antenna structure 16 mounted thereto. However, it is understood that coil 48 and magnet 50 can be located within the scanner assembly 32 as shown in U.S. patent application Ser. No. 09/928,758 or at a distance from scanner assembly 32 as described in the present application. Additionally, oscillator assembly 114 can be located at any other area on motor vehicular collision warning system 12 to provide oscillating motion to antenna structure 16.

Figure 4:
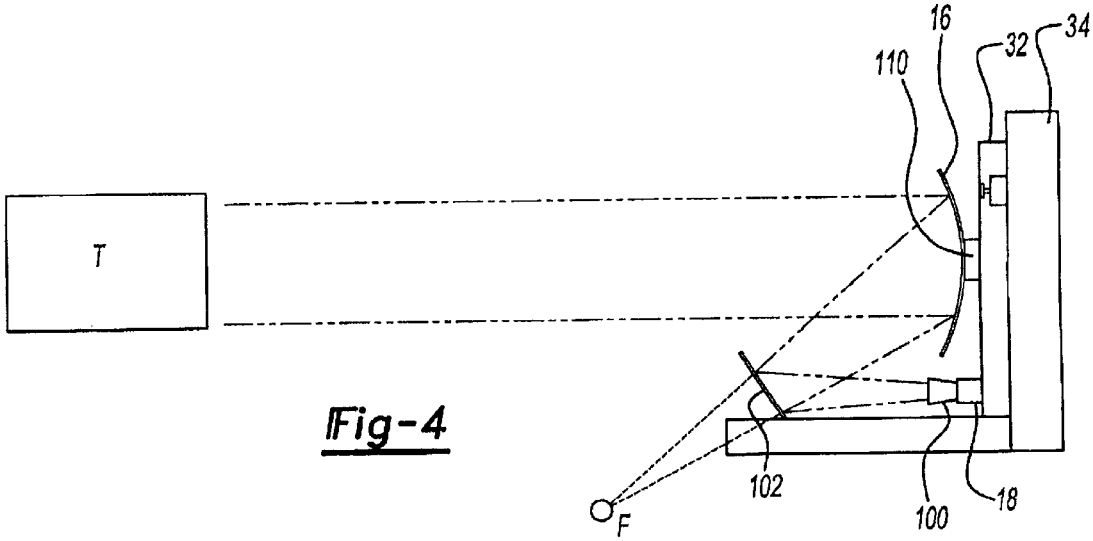
FIG. 4 is a schematic view showing the operation of the principal components of the scanner according to the present invention.

Referring now to FIGS. 3 and 4, the operation of the present invention is shown and described. Transceiver 18 emits radar signals through cone 100 in an expanding fashion. The radar signals are reflected by reflective plate 102 and are redirected toward antenna structure 16. The parabolic shape of antenna structure 16 collimates the radar signals and directs them in the direction of vehicle movement. This direction includes the location of target T, which is a potential obstruction to the path of the vehicle.

Figure 7:
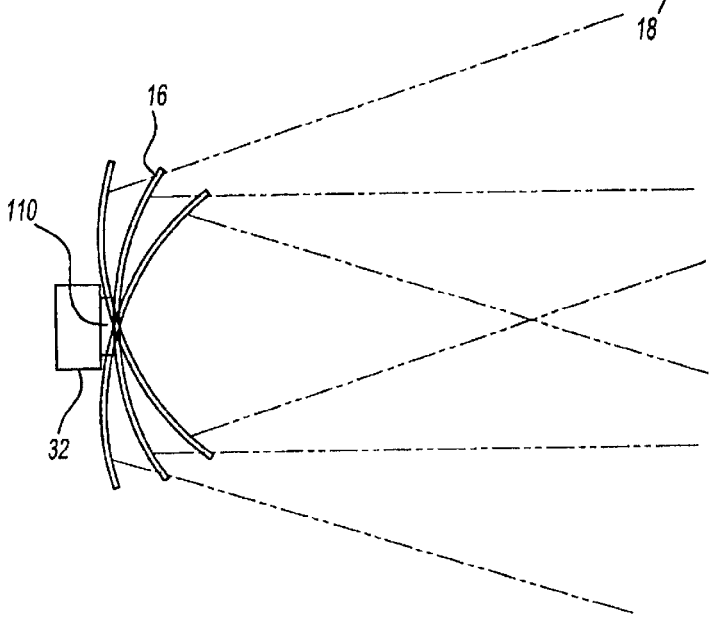
FIG. 7 is a schematic view showing the operation of the principal components of the wave antenna scanner according to the present invention.

The antenna structure 16 oscillates back and forth at an angle of preferably 12° or less in each direction by action of the scanner assembly 32 and the oscillator assembly 114. FIG. 7 schematically illustrates this back and forth oscillation. The signals can be passed through a lens positioned in front of the oscillating antenna structure 16 which may either refocus the radar signals or act to protect the components of motor vehicular collision warning system 12.

Reflected signals from the target T are then directed back toward the antenna structure 16. The antenna structure 16, in turn, redirects the reflected radar signals toward reflective plate 102, which in turn, directs the radar signals back toward the cone 100 and transceiver 18. The scanned signals are directed to a processor and then to a vehicle interface system for initiating warnings to the driver or adaptively controlling the vehicle.

Figure 5:
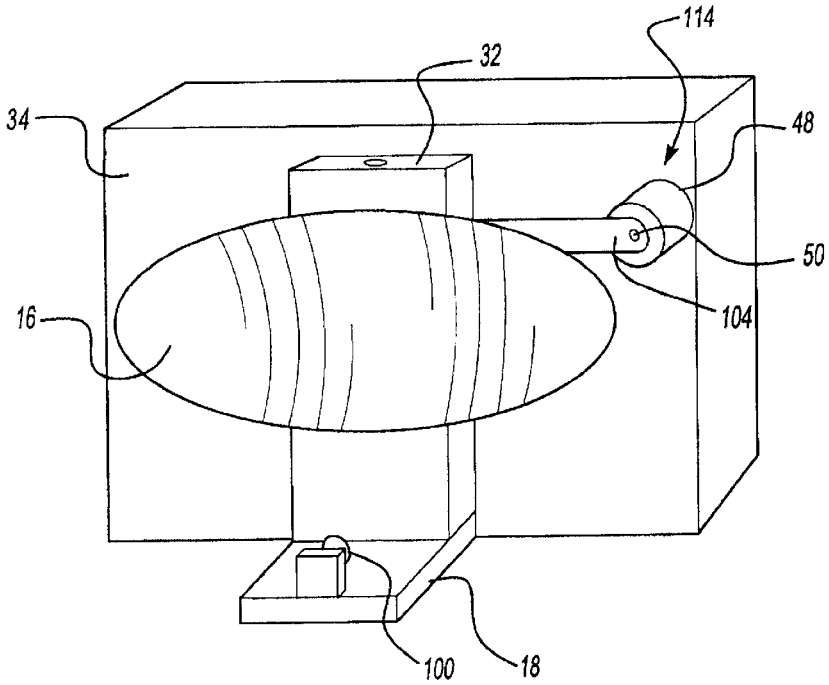
FIG. 5 is a perspective view of another embodiment of a vehicular collision warning system according to the present invention.
Figure 6:
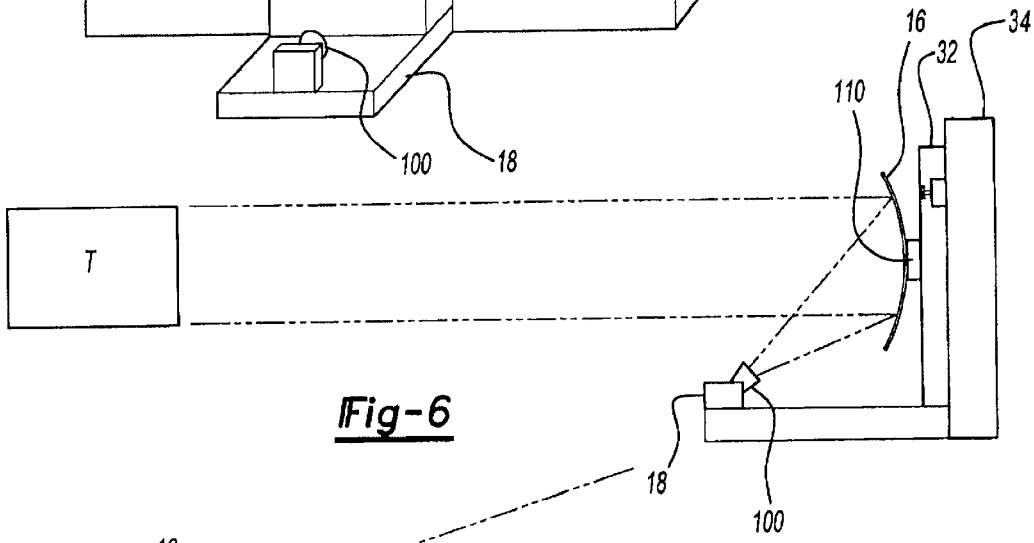
FIG. 6 is a schematic view showing the operation of the principal components of the vehicular collision warning system according to another embodiment of the present invention.

Referring to FIGS. 5 and 6, a second embodiment of the present invention is shown and described. The description for like elements is omitted. In FIG. 5, transceiver 18 is positioned at the focus of the elliptical antenna structure 16. The reflective plate 102 is omitted. As such, radar signals are transmitted from the transceiver and through the cone 100 to the antenna structure 16, thereby reflected to the target T. The repositioning of the transceiver 18 and cone 100 eliminates the need to provide a reflective plate 102.

Accordingly, it can be seen that repositioning of the elements of the motor vehicular collision warning system 12 as well as addition and omission of the reflective plate allows many size reduced configurations, while providing effective transmission and reception by the parabolic antenna structure.

It is to be understood that the above-described embodiment is merely illustrative of one embodiment of the principles of the present invention. Other embodiments can be devised by those skilled in the art without departing from the scope of the invention.

What is claimed is:

1. A sensing system for sensing an obstruction in a path of a vehicle, the sensing system comprising:

a reflective antenna adapted to reflect radar signals;

a scanner assembly rotatably mounting the antenna to a chassis;

a drive assembly for oscillating the antenna;

a transceiver coupled to the antenna to transmit radar signals to and receive radar signals from the antenna; and a processor coupled to the transceiver and adapted to determine when the obstruction exists in the path of the vehicle based on radar signals received by the transceiver.

wherein said radar signals transmitted to said antenna by said transceiver are reflected by said antenna in a substantially non-divergent configuration.

2. The sensing system according to claim 1, wherein the antenna is a parabolic dish.

3. The sensing system according to claim 2, wherein the transceiver is positioned at a focus point of the parabolic dish, the transceiver transmitting radar signals directly to and receiving radar signals directly from the parabolic dish.

4. The sensing system according to claim 2, further comprising a reflective plate that reflects radar signals between the parabolic dish and the transceiver.

5. The sensing system according to claim 1, wherein the antenna is detachably connected to the antenna scanner assembly by a detachable connection.

6. The sensing system according to claim 1, wherein the drive assembly includes a coil and magnet for driving the moving support when current is applied to the coil.

7. The sensing system according to claim 6, further comprising an arm connecting the magnet to the scanner assembly to transmit motion from the coil and magnet to the scanner assembly.

8. A sensing system for sensing an obstruction in a path of a vehicle, the sensing system comprising:

an antenna having a parabolic shape;

a scanner assembly rotatably mounting the antenna to a chassis;

a drive assembly oscillating the scanner assembly over a desired angular displacement, the drive assembly including a coil and magnet for driving the scanner assembly when current is supplied to the coil, the magnet attached to the scanner assembly by an arm;

a transceiver projecting radar signals to and receiving radar signals from the antenna, the antenna adapted to reflect radar signals from the transceiver toward a desired direction and direct reflected radar signals from the desired direction toward the transceiver; and a processor coupled to the transceiver and adapted to determine when an obstruction exists in the path of the vehicle based on radar signals received by the transceiver, the processor adapted to initiate an alarm or control the vehicle when the obstruction exists.

wherein said radar signals projected on to said antenna by said transceiver are reflected by said antenna in a substantially non-divergent configuration.

9. The sensing system as claimed in claim 8, further comprising a reflective plate positioned to reflect radar signals from the transceiver to the antenna and from the antenna to the transceiver.

10. A method for sensing obstructions in a path of a vehicle, the method comprising the steps of:

providing an antenna having a parabolic shape;

providing a transceiver that transmits and receives radar signals to and from the antenna;

transmitting radar signals from the transceiver to the antenna;

reflecting the radar signals by the antenna to form a columnar beam directed toward a desired direction;

receiving, with the antenna, reflected radar signals reflected from the desired direction;

directing, with the antenna, the reflected radar signals toward the transceiver;

processing the reflected radar signals received by the transceiver to determine whether or not an obstruction exists in the path of the vehicle; and initiating a response to the vehicle if an obstruction is determined to exist in the processing step.

11. The method according to claim 10, further comprising angularly oscillating the antenna at a desired frequency.

12. The method according to claim 11, wherein the antenna is oscillated at an angle of 12 degrees or less in each direction.

13. The method according to claim 11, further comprising the steps of:

reflecting reflected radar signals from the antenna to the transceiver with a reflective plate; and reflecting radar signals transmitted from the transceiver to the antenna with the reflective plate.

14. A vehicle comprising:

a sensing system for detecting an obstruction in a path of a vehicle, the sensing system comprising:

a reflective antenna adapted to reflect radar signals;

a scanner assembly rotatably mounting the antenna to a chassis;

a drive assembly for oscillating the antenna;

a transceiver coupled to the antenna to transmit radar signals to and receive radar signals from the antenna; and a processor coupled to the transceiver and adapted to determine when the obstruction exists in the path of the vehicle based on radar signals received by the transceiver, wherein said radar signals transmitted to said antenna by said transceiver are reflected by said antenna in a substantially non-divergent configuration.

15. The vehicle according to claim 14, wherein the antenna is a parabolic dish.

16. The vehicle according to claim 15, wherein the transceiver is positioned at a focus point of the parabolic dish, the transceiver transmitting radar signals directly to and receiving radar signals directly from the parabolic dish.

17. The vehicle according to claim 15, further comprising a reflective plate that reflects radar signals between parabolic he dish and the transceiver.

18. The vehicle according to claim 14, wherein the antenna is detachably connected to the antenna scanner assembly by a detachable connection.

19. The vehicle according to claim 14, wherein the sensing system is mounted to a front portion of the vehicle.

* * * * *

UNITED STATES PATENT AND TRADEMARK OFFICE

CERTIFICATE OF CORRECTION

PATENT NO. : 6,795,031 B1
DATED : September 21, 2004
INVENTOR(S) : Scott Walker et al.

It is certified that error appears in the above-identified patent and that said Letters Patent is hereby corrected as shown below:

Title page,
Item [57], ABSTRACT,
Line 2, delete "refelects" and insert -- reflects --
Line 3, insert -- a -- before "reflective plate"
Line 4, insert -- bounced off the -- before "antenna"
Line 7, delete "omitted" and insert -- omitting --

Column 5,
Lines 4 and 47, delete "." and insert -- , --

Signed and Sealed this

Twenty-third Day of November, 2004

JON W. DUDAS
*Director of the United States Patent and Trademark Office*